US009796064B2

(12) United States Patent
Holiness-Stalling et al.

(10) Patent No.: US 9,796,064 B2
(45) Date of Patent: Oct. 24, 2017

(54) QUICK CHANGE ADAPTER FOR GRINDING WHEELS

(71) Applicant: GM GLOBAL TECHNOLOGY OPERATIONS LLC, Detroit, MI (US)

(72) Inventors: Teresa U. Holiness-Stalling, Detroit, MI (US); John S. Agapiou, Rochester Hills, MI (US); Jae M. Lee, Sterling Heights, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 224 days.

(21) Appl. No.: 14/742,762

(22) Filed: Jun. 18, 2015

(65) Prior Publication Data

US 2016/0243671 A1 Aug. 25, 2016

Related U.S. Application Data

(60) Provisional application No. 62/117,992, filed on Feb. 19, 2015.

(51) Int. Cl.

| | |
|---|---|
| ***B24B 41/04*** | (2006.01) |
| ***B24D 5/16*** | (2006.01) |
| ***B24B 45/00*** | (2006.01) |
| ***B24B 23/02*** | (2006.01) |

(52) U.S. Cl.

CPC ..... *B24B 41/04* (2013.01); *B24B 23/022* (2013.01); *B24B 45/00* (2013.01); *B24D 5/16* (2013.01)

(58) Field of Classification Search

CPC ..... B24B 23/022; B24B 41/04; B24B 45/00; B24B 45/003; B24B 45/006; B24D 5/16

See application file for complete search history.

(56) References Cited

U.S. PATENT DOCUMENTS

| | | | | |
|---|---|---|---|---|
| 1,788,634 | A * | 1/1931 | Robinson | B24D 5/16 451/342 |
| 2,317,981 | A * | 5/1943 | De Vlieg | B24B 41/04 384/420 |
| 2,398,664 | A * | 4/1946 | Paul | B24B 45/00 451/342 |
| 3,746,411 | A * | 7/1973 | Kikuchi | B24B 41/04 384/368 |
| 4,731,955 | A * | 3/1988 | Henle | B24B 45/00 451/342 |
| 5,658,192 | A * | 8/1997 | Reinauer | B23B 29/046 408/238 |
| 6,419,430 | B2 * | 7/2002 | Hangleiter | B23B 31/261 279/137 |
| 2016/0332281 | A1 * | 11/2016 | Lee | B24B 5/42 |

* cited by examiner

*Primary Examiner* — Timothy V Eley
(74) *Attorney, Agent, or Firm* — Quinn IP Law

(57) ABSTRACT

A self-centering grinding wheel assembly that includes a spindle shaft including a conical-shaped end, a grinding wheel, and a grinding wheel adapter. The grinding wheel adapter affixed to the grinding wheel. A plurality of alignment members disposed radially within the grinding wheel adapter. Each of the plurality of alignment members include a tapered surface that conforms to a conical end of the spindle shaft. The plurality of alignment members slide radially with the grinding wheel adapter. The plurality of alignment members self-center the grinding wheel adapter on the spindle shaft in response to the grinding wheel adapter being assembled to the conical end of the conical shaft.

19 Claims, 8 Drawing Sheets

QUICK CHANGE ADAPTER FOR GRINDING WHEELS

CROSS-REFERENCE TO RELATED APPLICATIONS

This application claims priority of U.S. Provisional Application Ser. No. 62/117,992 filed Feb. 19, 2015, the disclosure of which is incorporated by reference.

BACKGROUND OF INVENTION

An embodiment relates to manufacturing operations, and more specifically, grinding wheels.

Manufacturing of parts, such as crank shafts, cam shafts, and transmission shafts and various other parts whether automotive or non-automotive require machining operations to grind the part to generate a desired shape. Such parts may be used in automotive, construction, nautical vessels, trains, airplanes, manufacturing appliances. Machining operations may include any process where raw material, such as metal, is cut into a final shape by a controlled material-removal process. This process typically involves a grinding wheel attached to a machine spindle shaft where the grinding wheel is rotated against the part to form the desired shape and size of the part.

The grinding wheel is interchangeable to the machine shaft so that different grinding wheels can be used to accommodate different parts to be machined by the machining operation. Typically changing out a grinding wheel to replace with a new grinding wheel takes roughly 4-6 hours. This time consuming operation and truing/dressing process is the result of trying to properly center the grinding wheel on the shaft to make sure the grinding wheel is square on the shaft and to eliminate run-out of the grinding wheel face relative to the shaft. Run-out is essentially the inaccuracy in a rotating system where the grinding wheel does not rotate exactly in line with the main axis of the shaft. Run-out is dynamic and cannot be compensated, therefore, it is essential in grinding operations to make sure that the grinding wheel is centered exactly on the shaft within tolerances so that there is no axial or radial run-out and the part is properly machined.

SUMMARY OF INVENTION

An advantage of the invention is the reduction of time to change a grinding wheel on a grinding wheel assembly where the grinding wheel adapter assembly self-aligns the grinding wheel on the spindle. Typically, an exchange of a grinding wheel takes approximately 8 hours that includes changing the dressing every time a wheel change occurs. The embodiments described herein eliminate dressing the wheel every time a wheel change occurs and allows for machine flexibility of difference sized grinding wheels. As a result, the apparatus described herein allows grinding crankshafts for multiple engine models with different journal width in a same grinder by simply changing wheels in a repeatable and relatively quickly process. The process is robust from dressing the grinding wheel every time a crankshaft model is changed in the machine. This apparatus reduced the grinding wheel time change from approximately 6 hours to less than 1 hour and eliminates the dressing process of the wheel between changes on the spindle. The self-alignment feature uses a grinding wheel adapter that includes sliding alignment members for accurately and repeatably self-aligning the spindle wheel adapter and affixed grinding wheel to the spindle. The apparatus eliminates the requirement of a dedicated machining system for each crankshaft model.

A self-centering grinding wheel assembly that includes a spindle shaft including a conical-shaped end, a grinding wheel, and a grinding wheel adapter. The grinding wheel adapter affixed to the grinding wheel. A plurality of alignment members is disposed radially within the grinding wheel adapter. Each of the plurality of alignment members including a tapered surface that conforms to a conical end of the spindle shaft. The plurality of alignment members slide radially with the grinding wheel adapter. The plurality of alignment members self-center the grinding wheel adapter on the spindle shaft in response to the grinding wheel adapter being assembled to the conical end of the conical shaft.

DETAILED DESCRIPTION

Figure 1:
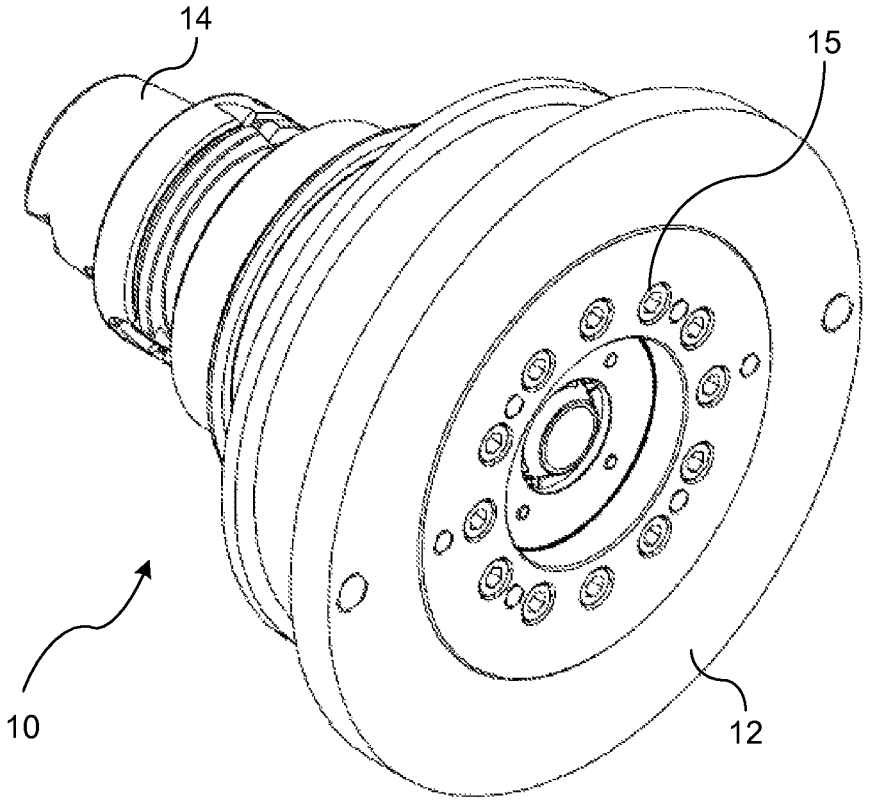
FIG. 1 is a pictorial illustration of a grinding wheel machining adapter system.

There is shown, in FIG. 1, a pictorial illustration of a grinding wheel machining adapter system 10. A grinding wheel 12 is shown mounted to a multi-component spindle shaft or tool holder 14. The multi-component spindle shaft 14 rotates the grinding wheel 12 which is used to machine a component such as a crankshaft for an engine. It should be understood that the grinding assembly may be used for components used in the following technology areas that include, but are not limited to, automotive, non-automotive, construction, nautical vessels, trains, airplanes, manufacturing systems, and appliances.

Current mounting configurations include a plurality of fasteners 15 extending through mounting holes in the grinding wheel 12 for attachment to the multi-component spindle shaft 14. The plurality of mounting holes have tolerances to allow the grinding wheel 12 to be aligned for mounting on the multi-component spindle shaft 14. A dressing process is typically utilized to center the grinding wheel 12 to reduce axial and radial run-out which may take substantially 4-6 hours.

Figure 2:
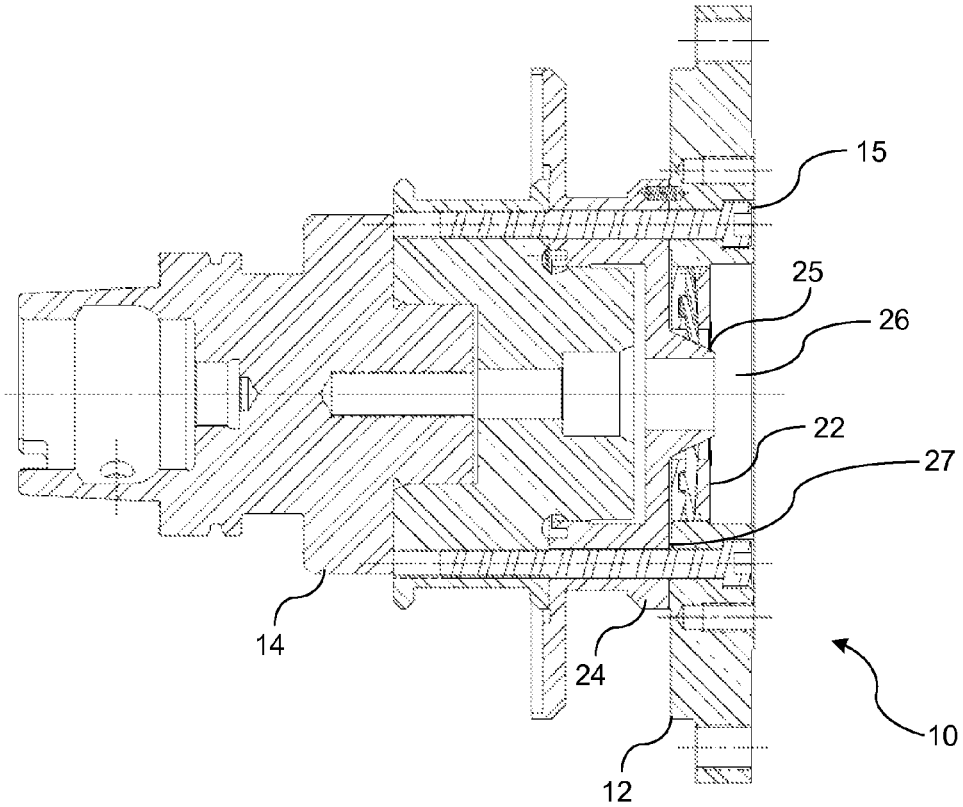
FIG. 2 illustrates a grinding wheel cross-section view of the grinding wheel adapter system.

One of the objectives is to eliminate the dressing cycle to reduce the setup time and the wear of the wheel due to dressing. To eliminate utilizing the dressing process, the adapter system 10 is utilized that allows for a grinding wheel 12 to be quickly changed out in a substantially decreased amount of time in contrast to conventional methods (e.g., 30 minutes). A quick interchangeable wheel provides flexibility with respect to product variation on the grinding diameter and width of journals. FIG. 2 illustrates a cross-section view of the adapter system 10. The adapter system 10 includes a sliding multi-piece conical configuration to allow accurate and repeatable interchangeability of a grinding wheel 12. The adapter system 10 includes the grinding wheel 12, a grinding wheel adapter 22, a spindle adapter 24, and a multi-component spindle shaft 14.

The spindle adapter 24 is mounted to the multi-component spindle shaft 14. The spindle adapter 24 has a conical-shaped end 25 and a flat face surface area 27 perpendicular to the conical-shaped end 25. The conical-shaped end 25 decreases in slope toward an end of the spindle adapter 24. The conical-shaped end 25 and the flat face surface area 27 are for mating with the grinding wheel adapter 22 and grinding wheel 12. The spindle adapter 24 and the multi-component spindle shaft 14 may be individual components coupled together or may be integrally formed as a single unit. The flat face surface area 27 on spindle adapter 24 abuts a face of the grinding wheel that controls the axial runout. The conical section 25 in spindle adapter 24 controls the radial runout with the wheel adapter 22.

The grinding wheel 12 is a circular grinding device having an outside circular edge surface used to grind a component. The grinding wheel 12 includes a center aperture 26 in which the grinding wheel adapter 22 is disposed therein. Preferably, the grinding wheel adapter 22 is press fit into the center aperture 26 for securing the grinding wheel adapter 22 to the grinding wheel 12. Alternatively, the grinding wheel adapter 22 may be secured to the grinding wheel 12 by techniques other than a press fit connection. In yet another embodiment, one of the disk plates is formed integral to the grinding wheel in the center aperture. The other disk plate is thereafter press fit and bolted to the disk plate integrally formed as part of the grinding wheel.

Figure 3A:
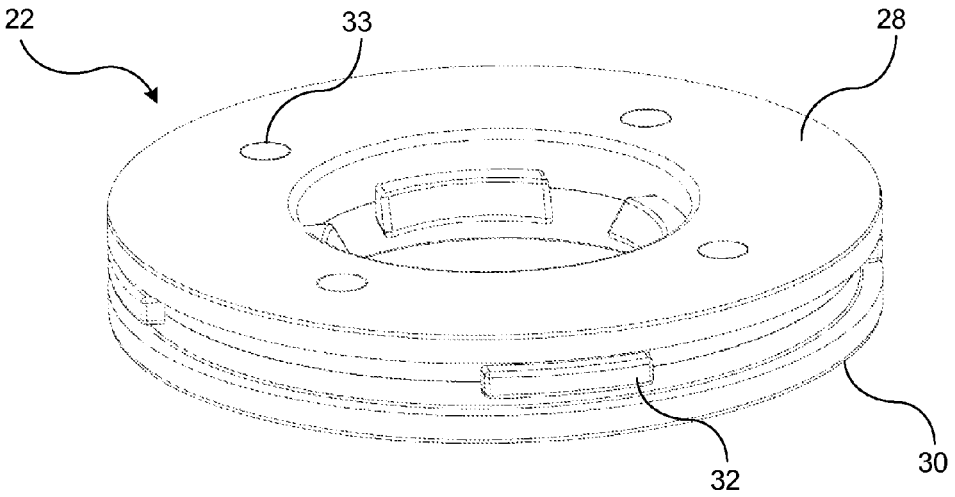
FIGS. 3*a-b* illustrate perspective views of the assembly of the grinding wheel adapter.
Figure 3B:
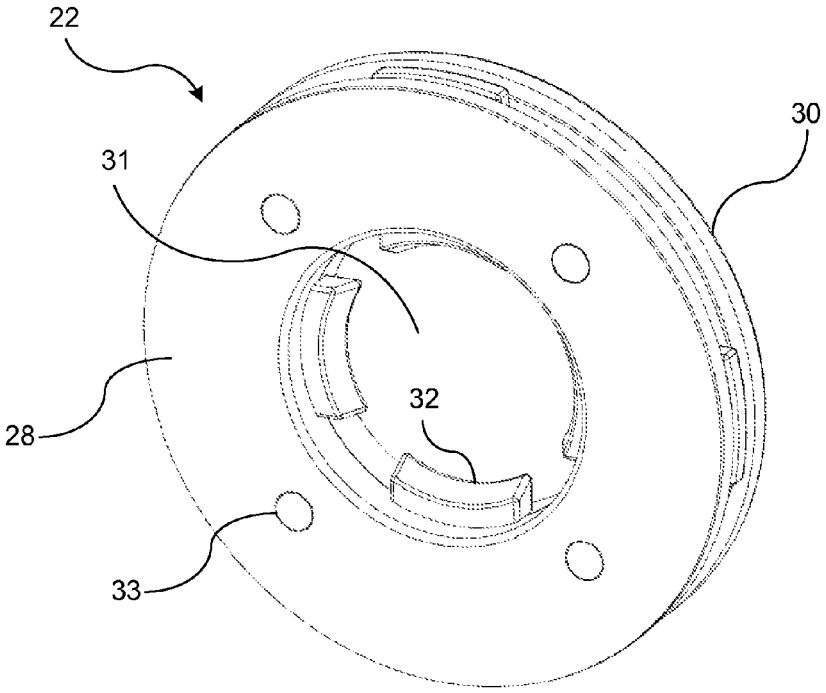

FIGS. 3*a-b* illustrate an assembly of the grinding wheel adapter 22. The grinding wheel adapter 22 includes a first disk plate 28, a second disk plate 30, and a plurality of alignment members 32. The plurality of alignment members 32 are disposed between the first disk plate 28 and second disk plate 30. The plurality of alignment members 32 are disposed between the first disk plate 28 and second disk plate 30 and extend radially into a center aperture 31 of both disk plates. A plurality of dowels 33 are press fit into apertures in the first disk plate 28 and the second disk plate 30 for securing the respective disk plates to one another. Alternatively, other types of fastening methods may be used to secure the respective plates to one another.

Figure 4A:
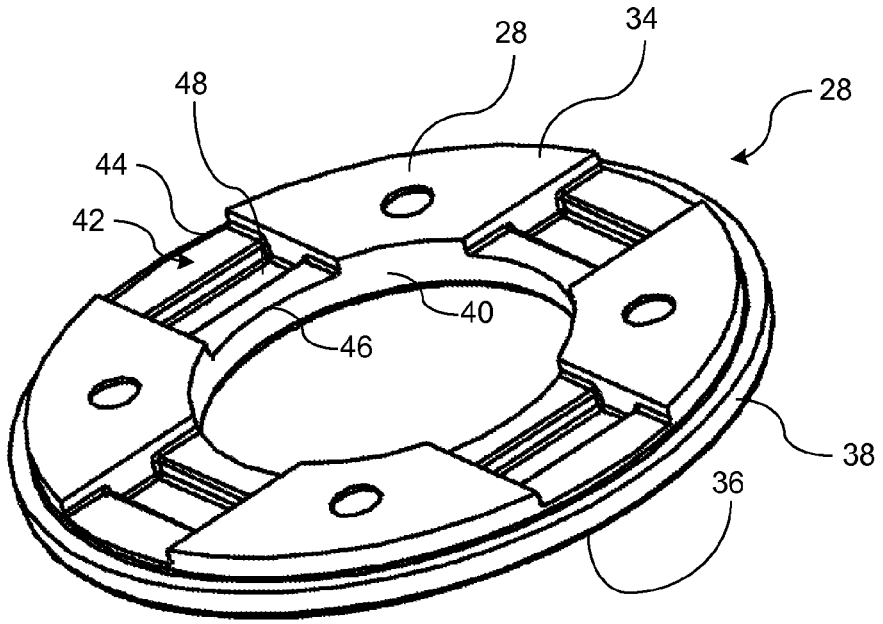
FIG. 4*a* is a perspective view of a first disk plate.
Figure 4B:
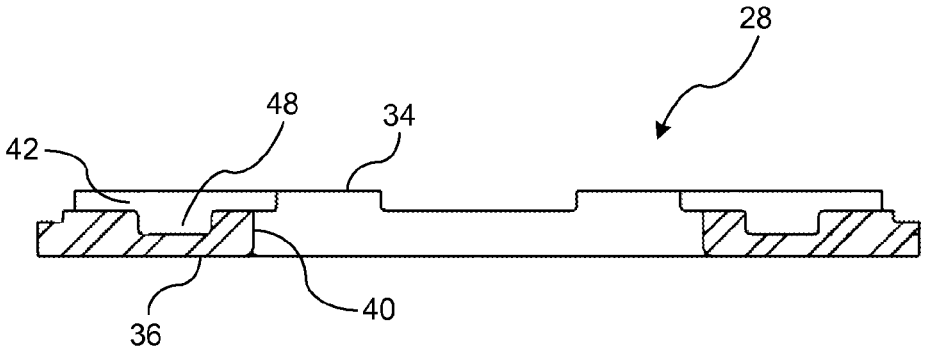
FIG. 4*b* is a cross-section view of the first disk plate.

FIGS. 4*a-b* illustrates a perspective view and a cross-section view of the first disk plate 28, respectively. The first disk plate 28 includes a first side surface 34 and a second side surface 36. The first disk plate 28 further includes an outer side circumference 38 and an inner side circumference 40. The outer side circumference 38 includes a stepped surface. The first disk plate 28 includes a plurality of primary channels 42 formed within the first side surface 34. The plurality of primary channels 42 are evenly spaced about on the first side surface 34. Preferably, four channels are formed on the first side surface 34 and are spaced 90 degrees apart from a centerline of the channels. Alternatively, any number of channels greater than two may be utilized; however, given the number of channels utilized, each of the channels should be evenly spaced from one another so that an even force is exerted on the conical end of the spindle adapter 24 for centering the grinding wheel 12 to the spindle adapter 24. For example, if three channels are utilized, then the channels should be spaced 120 degrees from a centerline of each channel. If five channels are utilized, then the channels should be spaced 72 degrees from a centerline of each channel.

The plurality of primary channels 42 are rectangular shaped having a first end 44 open to the outer side circumference 38, a second end 46 open to an inner side circumference 40. A top of the channel is open ended to for receiving the alignment member 32.

The first disk plate 28 further includes a plurality of secondary channels 48. A respective secondary channel 48 is formed on the bottom surface of each primary channel and extends perpendicular to each primary channel 42. The secondary channel 48 receives a guide member 62 (shown in FIG. 6*a*-6*c*) of the alignment member 32 that will be discussed in detail later.

Figure 5:
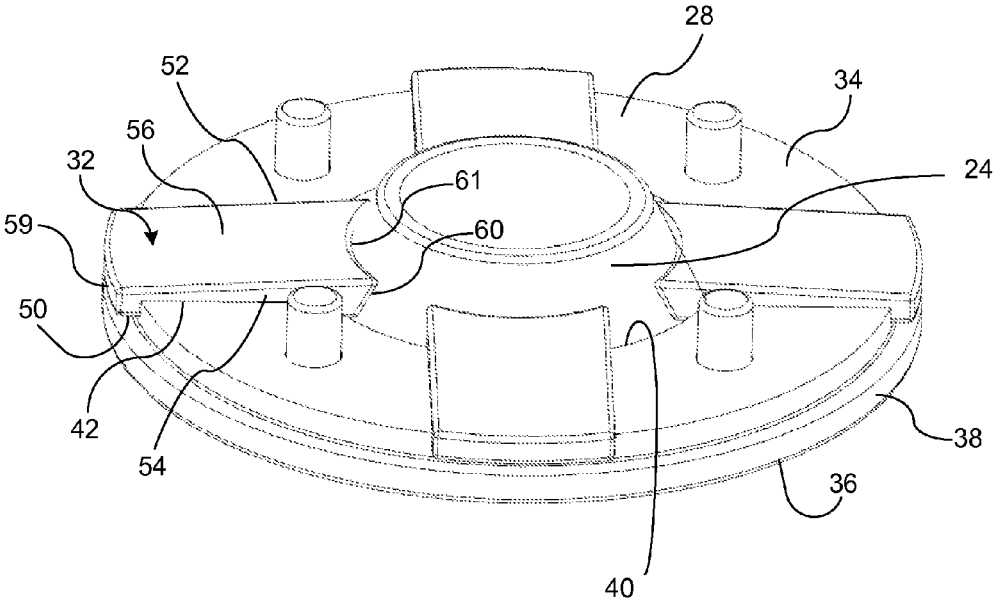
FIG. 5 is perspective view of the first disk plate with a plurality of alignment members and the top portion of the spindle adapter.

FIG. 5 illustrates a plurality of alignment members 32 slidingly disposed within the plurality of channels 42 of the first disk plate 28. The plurality of alignment members 32 include a bottom surface 50, a first side surface 52, a second side surface 54, and an inclined top surface 56. The bottom surface 50 and the first and second side surfaces 52 and 54 of a respective alignment member slidingly engages the three surfaces of each respective primary channel 42. The top side surface 56 of each alignment member 32 includes an inclined surface having a predetermined angle of inclination.

The plurality of alignment members 32 further includes an outer side surface 59 juxtaposed to the inner circumference of the grinding wheel and an inclined inner surface 60 that is juxtaposed toward the multi-component spindle shaft 14. The inclined inner surface 60 has a tapered surface that substantially matches the inclination of conical end of the spindle adapter 24.

The inclined inner surface 60 further includes a curvature 61 along a face of the inclined inner surface 60. The curvature 61 of the inclined inner surface 60 conforms to the curvature of the conical-shaped end 25 of the front of spindle adapter 24 (shown in FIG. 2).

Figure 6A:
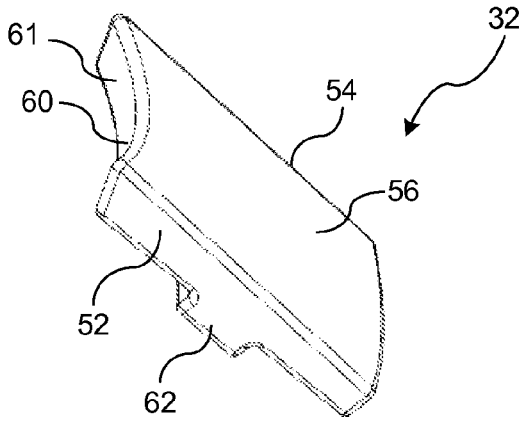
FIGS. 6*a-c* illustrate perspective views of the alignment members.
Figure 6B:
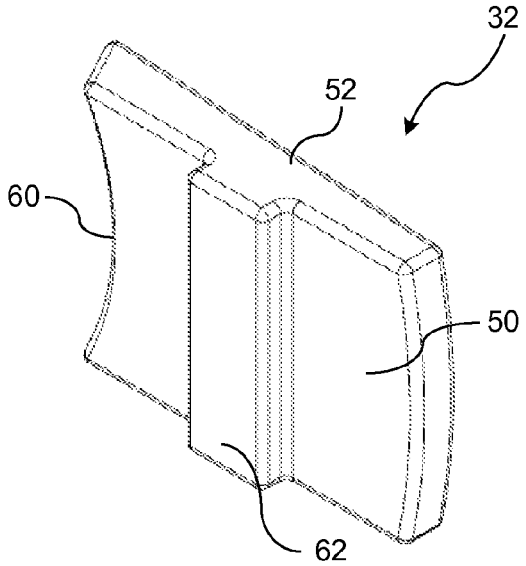
Figure 6C:
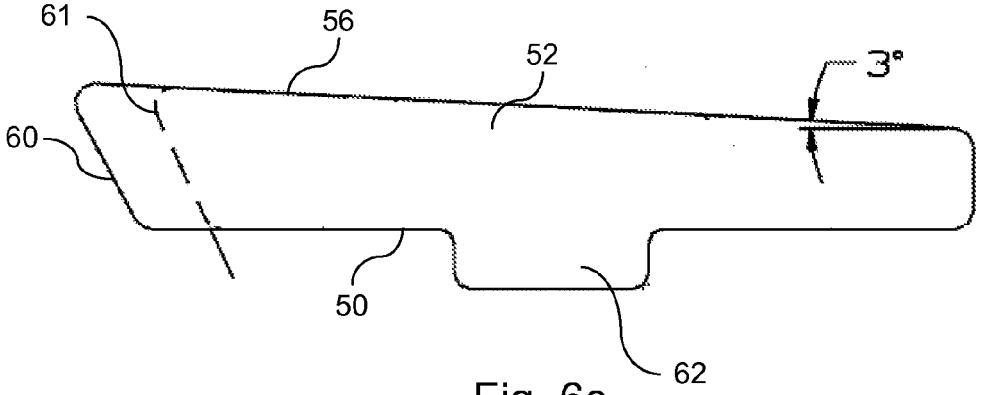

FIGS. 6*a-c* illustrate enlarged perspective views of the alignment members 32. The plurality of alignment members 32 each include a guide member 62 that protrudes outward from the bottom surface 50 that is of a predetermined width and extends laterally across the bottom surface 50. The guide member 62 is disposed within a respective secondary channel 48 of the first disk plate 28 when the alignment member 32 is disposed within the primary channel 42.

Figure 7A:
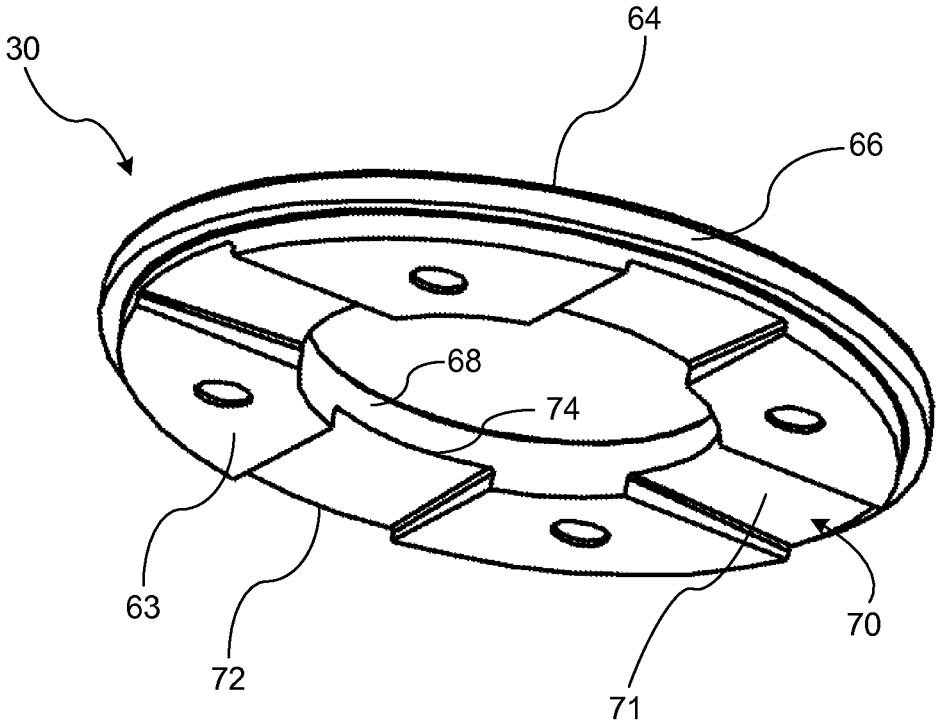
FIG. 7*a* is a perspective view of a second disk plate.
Figure 7B:
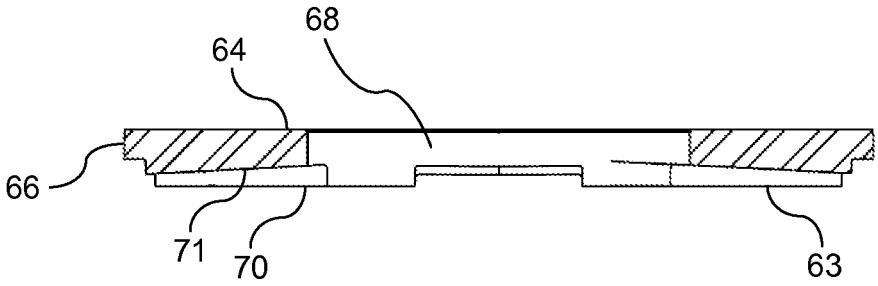
FIG. 7*b* is a cross-section view of the second disk plate.

FIGS. 7*a-b* shows the second disk plate 30 that includes a first side surface 63 and a second side surface 64. The second disk plate 30 further includes an outer side circumference 66 and an inner side circumference 68. The second disk plate 30 includes a plurality of channels 70 formed within the first side surface 63. The plurality of channels 70 are evenly spaced about the first side surface 63. The plurality of channels 70 align with the associated primary channels of the first disk plate 28. Each channel 70 includes an inclined surface 71 that substantially matches the inclination of the top surface 56 of the alignment members 32. The plurality of channels 70 are rectangular shaped having a first end 72 open to the outer side circumference 66. The plurality of channels 70 further include a second end 74 open to an inner side circumference 68. A bottom of each channel 70 is open ended for receiving the alignment members 32.

Figure 8A:
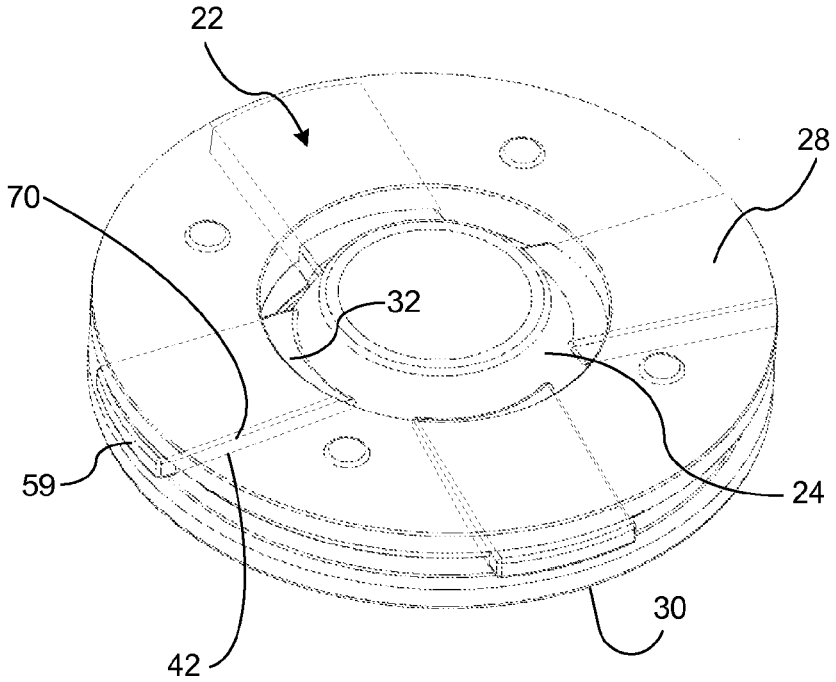
FIG. 8*a* illustrates a perspective view of the grinding wheel adapter mounted on the spindle adapter.

FIG. 8*a* illustrates the grinding wheel adapter 22 mounted on the spindle adapter 24. The first disk plate 28 is coupled to the second disk plate 30 where the respective channels 42 of the first disk plate 28 are aligned with respective channels 70 of the first second plate 30. The plurality of alignment members 32 is disposed within the aligned channels. Mating inclined surfaces 71 and the alignment members' 32 top surfaces allow for ease of movement of the alignment members 32 when a force is exerted on the alignment members 32 during alignment to the spindle adapter 24. The guide member 62 of each alignment member 32 is disposed within an associated secondary channel 48. Each of the alignment members 32 are limited in radial movement when the grinding wheel adapter 22 is mounted to the spindle adapter 24 by either the interaction between the guide member and the associated secondary channel 48 or by the grinding wheel 12 inner surface surrounding the center aperture 26 (shown in FIG. 2) abutting the outer side surface 59 of a respective alignment member 32 within the grinding wheel adapter 22. With respect to the interaction between the guide member and the secondary channel, exemplary design values may include the guide member 62 having a width of 6.4 mm secondary channel 48 having a width of 7.5 mm. This allows for limited radial movement of the alignment member 32 with the respective channels of the grinding wheel adapter 22. However, it should be understood that the channel widths and guide member width are exemplary and other dimensions and tolerances may be used without deviating from the scope of the invention. Whether limiting the radial movement of the alignment members 32 is accomplished by either the guide member/channel abutment or the alignment member outer side surface/inner wall grinding wheel abutment, the main factor is that an interference is created between the conical-shaped end 25 of the spindle adapter 24 and each of the inclined inner surfaces 60 of the alignment member 32. The interference should be of a magnitude that prevents the grinding wheel/adapter assembly from moving once centered and aligned to the spindle adapter 24, yet the interference should not be of such a magnitude that inhibits the grinding wheel/adapter assembly from readily being disassembled from the spindle adapter when a next grinding wheel/adapter assembly is changed out in the grinding machine. An example of such an interference may be 0.039 mm; however, it is understood that the interference is not limited to 0.039 mm and that other interference values may be used without deviating from the scope of the invention. As a result, both designs for limiting radial movement of the alignment members are utilized in cooperation with one another for creating the interference. It should be understood that designs other than described herein may be incorporated for generating the interference condition between the alignment members and the spindle adapter.

Figure 8B:
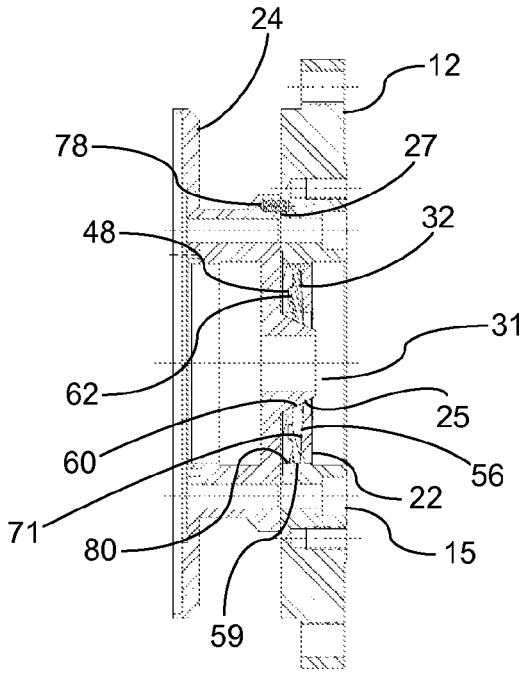
FIG. 8*b* is a cross-section view of the grinding wheel adapter (and attached grinding wheel) mounted on the spindle adapter.

FIG. 8*b* illustrates a cross-section view of the grinding wheel 12 and grinding wheel adapter 22, which is sub assembled prior to mounting onto the spindle adapter 24. The grinding wheel adapter 22 is secured to the spindle adapter 24 by the plurality of fasteners 15 and the face of the grinding wheel 12 mates with the flat face surface area 27 of the spindle adapter 24. The type of fasteners and the number of fasteners utilized to secure the grinding wheel adapter 22 to the spindle adapter 24 may vary depending on the manufacturer and application.

In response to assembling the grinding wheel adapter 22 and grinding wheel 12 to the spindle adapter 24, the subassembly is inserted over the conical-shaped end 25 of the spindle adapter 24 through a center aperture 31 of the grinding wheel adapter 22. As the subassembly is mounted over the spindle adapter 24, the conical-shaped end 25 of the spindle adapter 24 contacts each of the alignment members 32 and the face of the grinding wheel 12 makes contact with flat face surface area 27 of the spindle adapter 24. The alignment members 32 conform to the conical shaped end 25 of the spindle adapter 24 as a result of two design features of the alignment members 32 which are discussed as follows. The first feature of the alignment member 32 includes an inclined inner surface 60 which has a same degree of inclination as the conical wall 25 of the spindle adapter 24. For example, the inclined inner surface 60 of the alignment member 32 includes a 25 degree angle of inclination. Similarly the angle of inclination of the conical shaped end includes a 25 degree angle. Alternatively, a degree other than 25 degrees may be utilized.

The second feature of the alignment member 32 includes the curvature 61 of the inclined inner surface 60 to match the curvature of the conical shape 25 of the spindle adapter 24. As a result, the inclined inner surface 60 of each alignment member 32 matches the taper and curvature of the conical end 25 of the spindle adapter 24. It should be understood that the tolerances of the inclined surfaces of the alignment members 32 and the abutting surfaces of the first disk channel surface and conical adapter surface are critical for limiting any slop between mating components.

As the conical end 25 of the spindle adapter 24 slidingly engages the each of the alignment members 32, the alignment members 32 self-center the grinding wheel adapter 24 (and attached grinding wheel 12) on the spindle adapter 24. Although the conical end of the spindle adapter 24 may include small imperfection or slight out of round conditions, the secondary channels 48, and the grinding wheel 12 inner surface surrounding the center aperture 26, allow for limited movement of the guide members 62 of the alignment members 32 within the secondary channels 48 which allow the alignment members 32 to align and center the grinding wheel adapter 24 (and attached grinding wheel 12) onto the spindle adapter 24 and, in addition, the face of the grinding wheel 12 mates flush with the flat face surface area 27 of the spindle adapter 24. The movement of the alignment members 32 are limited by either the guide member 62 of the alignment member 32 abutting a wall of the second channel 48 and/or the outer side wall 59 of the alignment member 32 abutting an inner circumference wall 80 of the grinding wheel 12. This set-up eliminates axial and radial run-out. It should be understood that the multi-component spindle shaft 14 and spindle adapter 24 are positioned horizontally, and as a result, the subassembly of the grinding wheel 12 and the grinding wheel adapter 22 is vertically positioned as it is mounted on the horizontal multi-component spindle shaft 14. As a result, the alignment members 32 may be displaced from their original position for self-centering the grinding wheel adapter 22 and grinding wheel 12 subassembly on the spindle adapter 24 as the subassembly is fully seated on the spindle adapter 24. The inclined surfaces between the top surface 56 of the alignment member 32 and the inclined surface 71 of the first disk plate 28 allow for ease of movement of the alignment members 32 when a force is exerted on the inclined inner surface 60 of the alignment member 32 by the conical end of the spindle adapter 24 during the self-centering process. As a result, a radial run-out of the grinding wheel 12 is controlled by the conical design 25 of the spindle adapter 24 assembly. In addition, the axial run-out is controlled by face contact of the grinding wheel 12 with the flat face surface area 27 of the spindle adapter 24. The design of the two pieces adapter incorporates the required tolerances to allow control of the radial run-out while the axial run-out is present during the assembly of the grinding wheel on the spindle adapter and tightening of the bolts on the face of the grinding wheel.

The grinding wheel 12 is an integral part with grinding wheel adapter 22. The grinding wheel 12 is mounted on the nose of the spindle adapter 24. The mounting position of the grinding wheel 12 to the spindle shaft orientation should be clocked so that any runout present in the spindle that is corrected on the grinding wheel 12 by the initial dressing cycle is eliminated after an exchange of the grinding wheel 12. The grinding wheel should be mounted consistently during exchanges after the initial setup and dressing. Therefore, an error proofing method(s) is designed in the spindle adapter 24 to prevent wheel mounting in a wrong position. If not properly mounted, the grinding wheel runout can be very excessive resulting in non-usable parts. For example, the mating position of the grinding wheel can be stamped on both joining adapters, 22 and 24 respectively, or use a feature in the adapters 22 and 24 such as a solid or hollow dowel 78 or one of the screws can be smaller or larger to prevent the wrong orientation of the wheel on the spindle. It is important to notice that if the runout of the spindle is negligible and the manufacturing quality of the grinding wheel adapter 22 and spindle nose or spindle adapter 24 are perfect, the orientation of the grinding wheel to the spindle will not be necessary.

As described above, the grinding wheel is mounted on the grinding wheel adapter by press-fit method to become an integral component. However, the grinding wheel can be mounted to the grinding wheel adapter by other mechanical methods. In addition, a Carbon Fiber Re-enforced Plastic wheel (for weight reduction and easy of assembly) can be manufactured directly in the grinding wheel adapter.

While certain embodiments of the present invention have been described in detail, those skilled in the art to which this invention relates will recognize various alternative designs and embodiments for practicing the invention as defined by the following claims.

What is claimed is:

1. A self-centering grinding wheel assembly comprising:
a spindle shaft including a conical-shaped end;
a grinding wheel;
a grinding wheel adapter affixed to the grinding wheel; and
a plurality of alignment members disposed radially within the grinding wheel adapter, each of the plurality of alignment members including a tapered surface that conforms to the conical-shaped end of the spindle shaft;
wherein the plurality of alignment members slide radially within the grinding wheel adapter, and wherein the plurality of alignment members self-center the grinding wheel adapter on the spindle shaft in response to the grinding wheel adapter being assembled to the conical-shaped end of the spindle shaft.

2. The self-centering grinding wheel assembly of claim 1 wherein the tapered surface of each alignment member includes a curvature that conforms with the conical-shaped end of the spindle shaft.

3. The self-centering grinding wheel assembly of claim 2 wherein the grinding wheel adapter includes a first disk plate and a second disk plate, the plurality of alignment members are radially disposed between the first disk plate and the second plate.

4. The self-centering grinding wheel assembly of claim 3 wherein the first disk plate includes a first side surface, a second side surface, an inner circumference surface, and an outer circumference surface, wherein at least one primary channel is formed in the first side surface, the primary channel extending radially within the first side surface, wherein the primary channel is open ended to the inner circumference surface and the outer circumference surface.

5. The self-centering grinding wheel assembly of claim 4 wherein the second disk plate includes a first side surface, a second side surface, an inner circumference surface, and an outer circumference surface, wherein at least one channel is formed in the first side surface, the channel extending radially and being open ended to the inner circumference surface and the outer circumference surface, wherein each channel of the second disk plate is aligned with an associated primary channel of the first disk plate.

6. The self-centering grinding wheel assembly of claim 5 wherein each alignment member is slidingly disposed within each of the aligned primary channels of the first disk plate and the channels of the second disk plate.

7. The self-centering grinding wheel assembly of claim 6 wherein each alignment member includes a guide member protruding from a bottom surface of each alignment member, wherein the guide member extends laterally across the bottom surface of the alignment member, and wherein each alignment member includes a top inclined surface.

8. The self-centering grinding wheel assembly of claim 7 wherein the first disk plate further includes a secondary channel extending perpendicular below a bottom side surface of each primary channel, wherein each guide member of each alignment member include a width that is smaller than a width of the secondary channel for allowing radial movement of each alignment member.

9. The self-centering grinding wheel assembly of claim 8 wherein the width of the secondary channel limits the radial distance that each alignment member may be radially displaced within each primary channel.

10. The self-centering grinding wheel assembly of claim 9 wherein the plurality of alignment members are substantially rectangular-shaped.

11. The self-centering grinding wheel assembly of claim 9 wherein the primary channel of the second disk plate includes an upper inclined surface, wherein a mating interaction between the upper inclined surface of the primary channel of the second disk plate and the top inclined surface of the alignment member allow for ease of movement of the alignment members when a force is exerted on the alignment members during alignment of the grinding wheel adapter to the spindle shaft.

12. The self-centering grinding wheel assembly of claim 11 wherein the grinding wheel includes a center aperture, wherein the grinding wheel adapter is secured to the grinding wheel within the center aperture.

13. The self-centering grinding wheel assembly of claim 12 wherein the grinding wheel adapter is secured to the grinding wheel by a press fit connection.

14. The self-centering grinding wheel assembly of claim 13 wherein the grinding wheel and grinding wheel adapter are secured to the spindle shaft by a plurality of fasteners.

15. The self-centering grinding wheel assembly of claim 12 wherein a second side surface of the first disk plate is substantially flat, wherein the spindle shaft includes a substantially flat side surface, and wherein the substantially flat second side surface of the first disk plate mates with the substantially flat side surface of the spindle shaft eliminating axial runout when the grinding wheel and grinding wheel adapter are secured to the spindle shaft.

16. The self-centering grinding wheel assembly of claim 12 wherein the tapered surface of each alignment member mates with the conical-shaped end of the spindle shaft eliminating radial runout when the grinding wheel and grinding wheel adapter are secured to the spindle shaft.

17. The self-centering grinding wheel assembly of claim 16 wherein the first disk plate is integrally formed to the grinding wheel, and wherein the second disk plate is affixed to the integrally formed first disk plate and grinding wheel.

18. The self-centering grinding wheel assembly of claim 16 wherein the second disk plate is integrally formed to the grinding wheel, and wherein the first disk plate is affixed to the integrally formed second disk plate and grinding wheel.

19. The self-centering grinding wheel assembly of claim 16 further comprising at least two different sized fastening members to affix the grinding wheel to the grinding wheel adapter, the at least two different sized fasteners assist in defining an orientation of the grinding wheel to the grinding wheel adapter.

* * * * *